US006349657B1

(12) United States Patent
Wohlford

(10) Patent No.: US 6,349,657 B1
(45) **Date of Patent: *Feb. 26, 2002**

(54) KIT FOR ASSEMBLING AN AUDIOVISUAL COMPONENT STORAGE BASE WITH A TELEVISION TURNTABLE

(75) Inventor: James G. Wohlford, Minneapolis, MN (US)

(73) Assignee: Decade Industries, Inc., Arden Hills, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/192,623

(22) Filed: Nov. 16, 1998

(51) Int. Cl.[7] ..... A47B 57/00
(52) U.S. Cl. ..... 108/94
(58) Field of Search ..... 108/94, 95, 103, 108/108; 240/349.1, 430, 425; 211/129.1, 131.1

(56) References Cited

U.S. PATENT DOCUMENTS 2,453,443 A * 11/1948 Logan ..... 108/94
3,858,529 A * 1/1975 Salladay ..... 108/103
4,635,894 A * 1/1987 Sammons ..... 248/349.1 X
4,827,638 A * 5/1989 Peters ..... 108/94 X
4,926,759 A * 5/1990 Vitsky et al. ..... 108/180
5,343,816 A * 9/1994 Sideris ..... 108/94
5,479,867 A * 1/1996 Blevins et al. ..... 108/94
5,720,524 A * 2/1998 Hall ..... 108/94 X

* cited by examiner

*Primary Examiner*—Jose V. Chen
(74) *Attorney, Agent, or Firm*—Kinney & Lange, P.A.

(57) ABSTRACT

A kit for assembling an audiovisual component storage stand with one of a plurality of variously sized television turntables. The kit has a base, a plurality of support pillars, one of a plurality of variously sized television turntables and a rotating member. The rotating member is attached to the base. The television turntable has a top side and a bottom side. The base has a top side and a bottom side. Each of the plurality of support pillars has a top side and a bottom side. The top side of each of the plurality of support pillars is attached to the bottom side of one of the plurality of variously sized television turntables. The bottom side of each of the plurality of support pillars is attached to the top side of the base so that a space for receiving audiovisual components is defined between the plurality of support pillars. The rotating member is rotatably attached to the base to allow both the base and the television turntable to rotate together.

32 Claims, 3 Drawing Sheets

KIT FOR ASSEMBLING AN AUDIOVISUAL COMPONENT STORAGE BASE WITH A TELEVISION TURNTABLE

CROSS-REFERENCE TO RELATED APPLICATION(S)

None.

BACKGROUND OF THE INVENTION

The present invention relates to furniture for storing and displaying audiovisual components. Specifically, the present invention relates to a universal audiovisual component storage base set which may be assembled and attached to numerous sizes of television turntables by a consumer.

Typically, furniture for storing audiovisual components is assembled and manufactured to fit specific sizes of televisions and audiovisual components. In order to accommodate all of the possible permutations of audiovisual components and televisions, a manufacturer or retailer had to inventory numerous storage furniture kits. Furniture which accommodated a large television necessitated a completely different set of stocked parts than furniture meant for use with a smaller television. As a result, the cost of inventorying and manufacturing the various sizes of component furniture was high.

Many times, the size and complexity of the storage furniture did not allow both the television and the associated audiovisual components to rotate together. This prevented the user from easily monitoring both the television and the related components from various angles throughout the viewing area.

Finally, audiovisual storage furniture which was meant to be assembled in a user's home required sorting out and assembling a complicated array of fasteners and furniture pieces. As the number of fasteners and pieces in the furniture kit increased, so did the chance that the consumer would be missing the required pieces or the proper tools to assemble the furniture. As a result, many consumers who attempted to assemble audiovisual component kits became frustrated.

Accordingly, there is a need for a kit which contains parts which may easily be assembled to fit varying sizes of televisions and monitors. A simple kit with few parts and fasteners which may be fitted to varying sizes of turntables would greatly reduce the cost of manufacturing and inventorying numerous sizes and shapes of audiovisual furniture. At the same time, such a kit would reduce the possibility of consumer dissatisfaction resulting from assembling a dizzying array of complicated parts and fasteners with tools not typically on hand for the consumer.

BRIEF SUMMARY OF THE INVENTION

The present invention provides a simple universal kit for assembling an audiovisual component storage base to varying sizes of television turntables. The present invention allows one set of furniture parts to fit with one of a plurality of variously sized turntables. In addition, the present invention allows for easy assembly with a minimum of parts and fasteners. Further, the present invention allows for audiovisual components to rotate with the television or monitor so that the components and the monitor may be easily manipulated and observed by the user.

The present invention includes a base, a plurality of support pillars a plurality of fasteners, and a television turntable having a rotating member. Both the television turntable and the base have a top side and a bottom side.

Each of the plurality of support pillars has a top side and a bottom side as well. The rotating member may be attached to the bottom side of the television turntable initially to create a stand-alone rotating platform for supporting a television. Before assembling the storage stand and television turntable, the rotating member is removed from the bottom side of the television turntable.

To assemble the audiovisual component storage base with the television turntable, the bottom side of each of the plurality of support pillars is attached to the top side of the base. Next, the top of each of the plurality of support pillars is attached to the bottom side of the television turntable. A space for storing audio visual components associated with a television is defined between the plurality of support pillars, above the top side of the base and below the bottom side of the television turntable. Finally, the rotating member is reattached to the bottom side of the base.

In one embodiment, the audiovisual storage stand kit contains one of a plurality of variously sized television turntables, a rotating member, fasteners such as dowels and screws and a plurality of support pillars. Each of the plurality of support pillars has standard holes in its top side and bottom side. The standard set of holes in the top side of each of the plurality of support pillars align with holes in the top side of the television turntable. Since each one of the plurality of television turntables has the same set of standard holes in its bottom side, one audiovisual storage base set adapts to numerous television turntables. Similarly, standard holes in the bottom side of each of the plurality of support pillars align with holes in the base.

During assembly, fasteners such as dowels are inserted into the holes in the top side of each of the plurality of the support pillars so that the fasteners still protrude from the top side of each of the plurality of support pillars. The protruding portions of the fasteners are then inserted into the corresponding holes in the bottom side of the television turntable. Fasteners, such as screws, are inserted through the holes in the base and screwed into the corresponding holes in the bottom side of the support pillars. Finally, a fastener such as a screw, secures the rotating member to the bottom side of the base so that the assembled television turntable and audio visual component storage base rotate as one.

DETAILED DESCRIPTION

Figure 1:
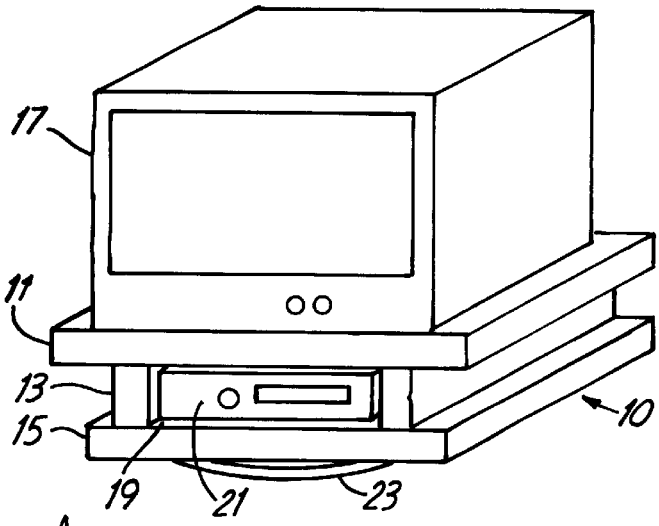
FIG. 1 shows a perspective view of an assembled television turntable and audiovisual storage base as it may be used by a consumer.

An embodiment of the present invention is shown fully assembled as it may be used by the consumer in FIG. 1. Fully assembled audiovisual component storage base and television turntable 10 has television turntable 11 supported by support pillars 13 above base 15. Television 17 rests on television turntable 11. Space 19 for storing audiovisual components, such as video cassette recorder (VCR) 21, is defined between the plurality of support pillars 13. Rotating member 23 is attached to the bottom of base 15 to allow base 15 and television turntable 11 to rotate together with respect to rotating member 23. The kit creates a compact rotating turntable and storage base.

Figure 2A:
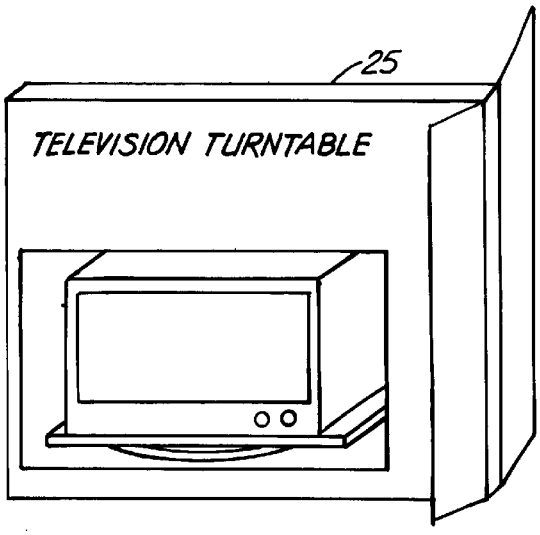
FIG. 2A shows a perspective view of one television turntable set boxed as a consumer would purchase it.
Figure 2A:
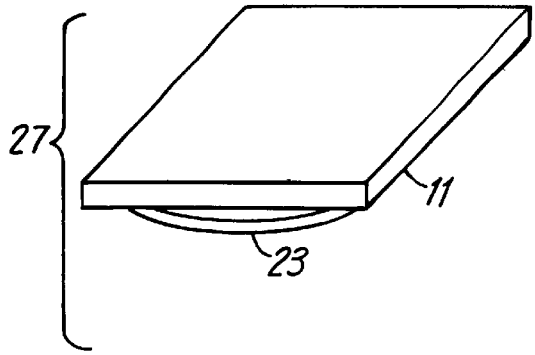

FIG. 2A shows box 25 containing one of a plurality of television turntable sets 27 selected by the consumer having one of a plurality of television turntables 11 selected by the consumer and rotating member 23. Rotating member 23 maybe rotatably attached to television turntable 11 to create a rotating platform for supporting a television. Although box 25 may contain one of a plurality of television turntable sets 27 selected by the consumer which may contain one of a plurality of variously sized television turntables 11, included rotating member 23 is one standard size regardless of which television turntable set 27 is selected. As a result, regardless of which television turntable 11 is selected by the consumer, only one size and shape of rotatable member 23 need be accommodated by any later attached furniture components.

Figure 2B:
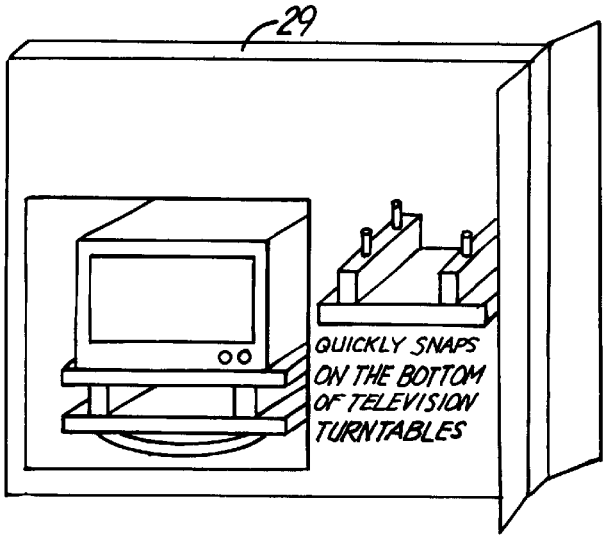
FIG. 2B shows a perspective view of a universal storage base set boxed as a custumer would purchase it.
Figure 2B:
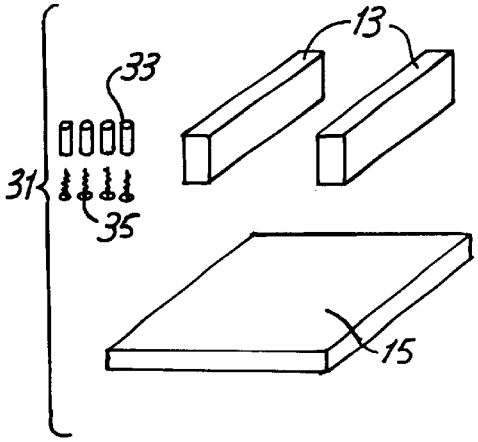

FIG. 2B shows box 29 containing universal storage base set 31 as it is purchased by a consumer. Universal storage base set 31 may be assembled and attached to one of a plurality of television turntables 11 to create a combination television turntable and audiovisual component storage base 10 seen in FIG. 1. Universal storage base set contains support pillars 13, base 15, and fasteners, such as dowels 33 and screws 35. In the present invention, one universal storage base set 31 may be matched with any one of a plurality of television turntable sets 27, reducing the need to inventory numerous storage base sets in order to accommodate numerous television turntable sets.

Figure 3:
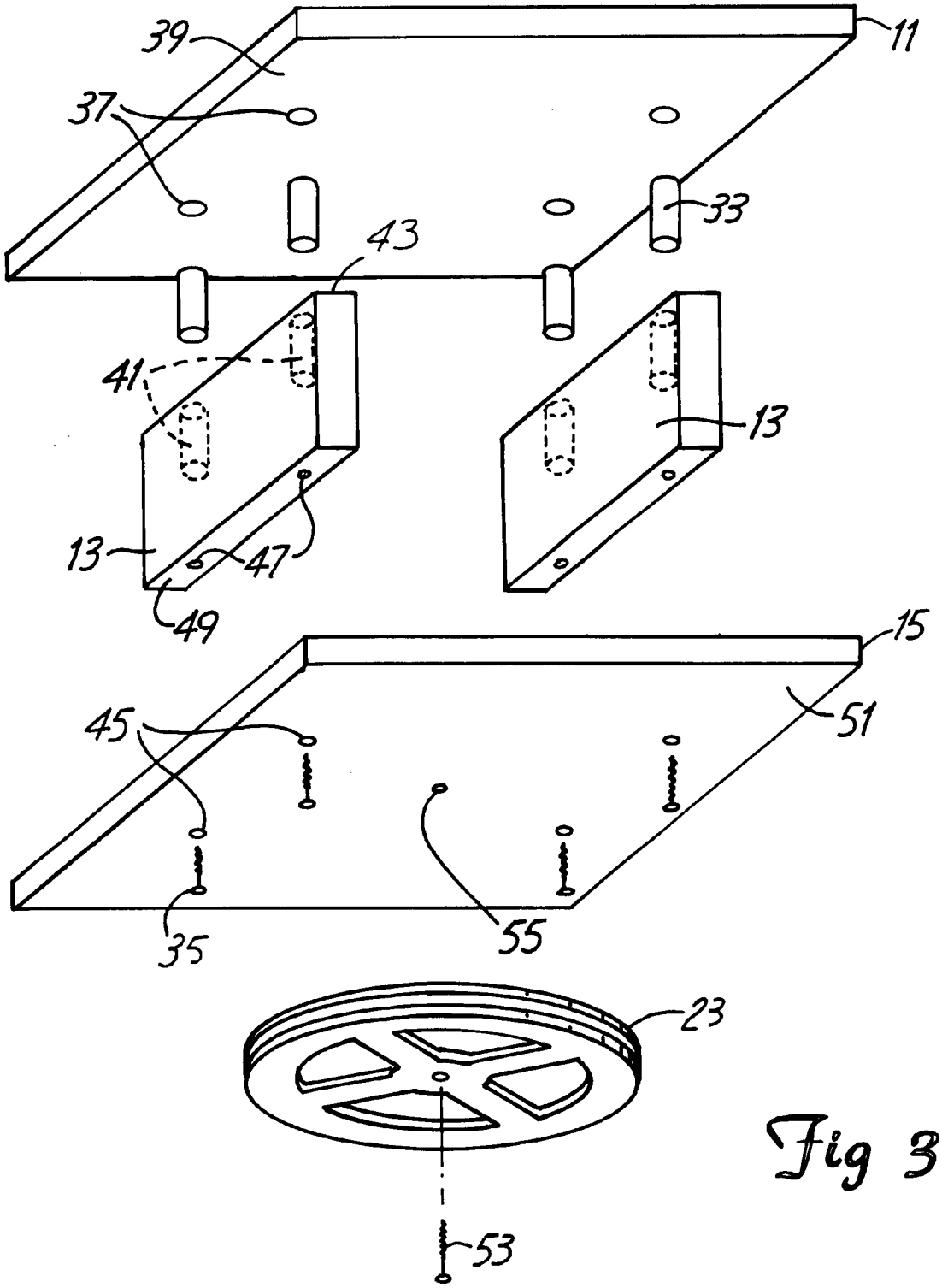
FIG. 3 shows an exploded perspective view of the components of the kit.

FIG. 3 shows both sets of kit components before assembly. Standard holes 37 are disposed on bottom side 39 of television turntable 11. Standard holes 37 in the bottom side 39 of television turntable 11 align with standard holes 41 in top side 43 of each of the plurality of support pillars 13. Fasteners such as dowels 33 secure top side 43 of each support pillar 13 to bottom side 39 of television turntable 11. Standard holes 45 in base 15 align with standard holes 47 in bottom 49 of each of the plurality of support pillars 13. Fasteners, such as screws 35, are inserted through holes 45 in base 15 and are screwed into aligned holes 47 in bottom side 49 of each of the plurality of support pillars 13. Rotating member 23 is attached to bottom side 51 of base 15 with fastener such as screw 53 to complete assembly of the invention.

Once the consumer has selected a television turntable set and purchased the universal storage base set, and removed the kit components from their respective boxes, the kit of the present invention may be easily assembled by the consumer in four steps. First, screws 35 are inserted through holes 45 in base 15 and screwed into aligned holes 47 in bottom side 49 of each of the plurality of support pillars 13. Second, fasteners such as dowels 33 are inserted into holes 41 in top side 43 of each of the plurality of support pillars 13 so that the dowels 33 still protrude from the top side 43 of each of the plurality of support pillars 13. Third, dowels 33 are pushed into aligned holes 37 in bottom side 39 of television turntable 11. Fourth, rotating member 23 is aligned with pilot hole 55 and screwed to bottom side 51 of base 15 with fastener such as screw 53 to complete assembly of the audiovisual storage stand.

Figure 4:
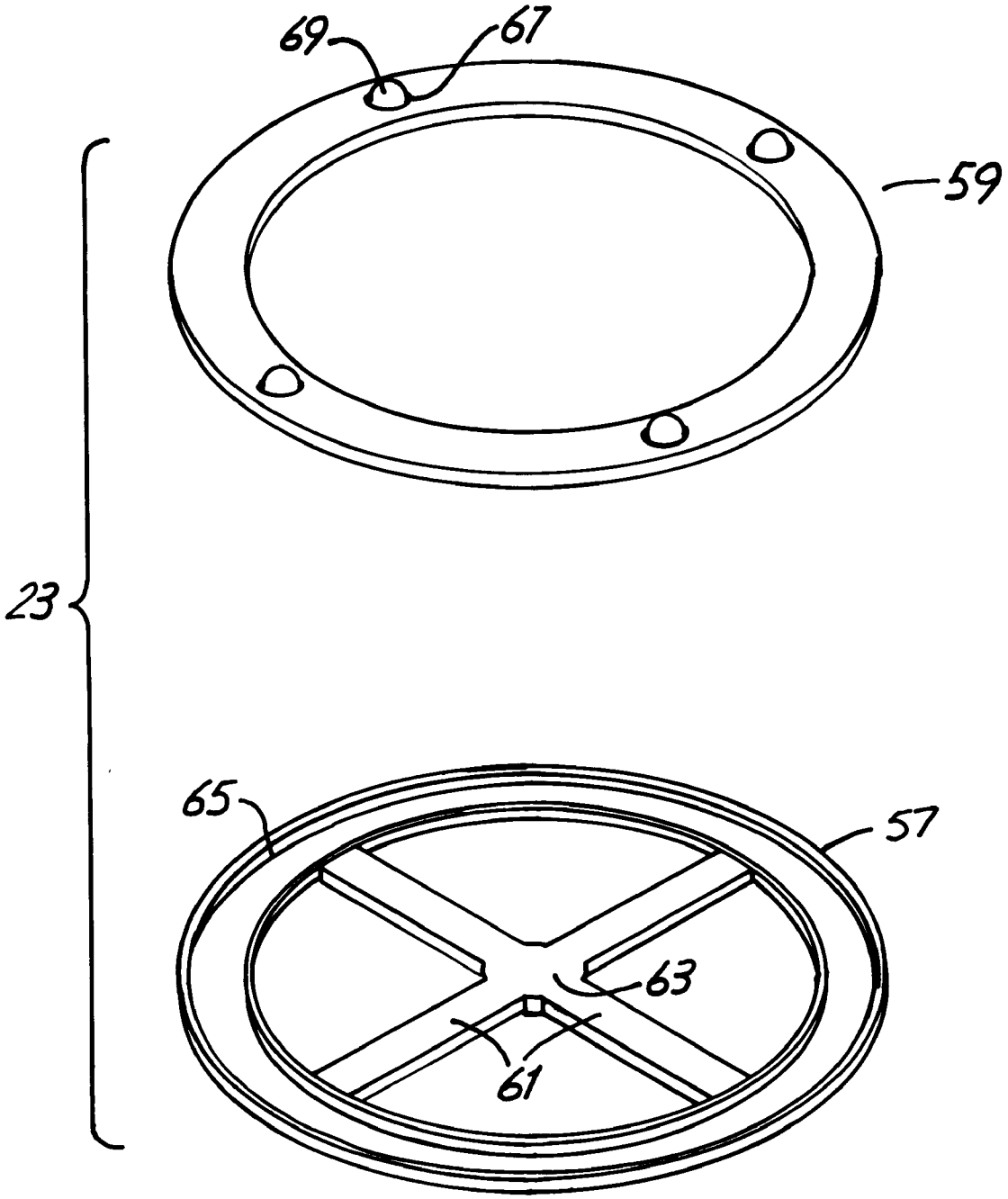
FIG. 4 shows an exploded perspective view of the rotating member.

FIG. 4 shows a more detailed version of the preferred embodiment of rotating member 23. Rotating member 23 is made up of outer ring 57 and inner ring 59. Both outer ring 57 and inner ring 59 may be formed of a nylon material. Spokes 61 connect outer ring 57 to center portion 63. Groove 65 is disposed in the circumference of outer ring 57. Groove 65 accepts inner ring 59. Each hole 67 in inner ring 59 rotatably holds a ball bearing 69. Inner ring 59 is slidably seated in groove 65 in outer ring 57. Rotating member 23 is then secured to base 15 so that inner ring 59 rotatably engages bottom side 51 of base 15. One rotating member configuration is used with each of a plurality of television turntables. As a result only one rotating member configuration need be accommodated by a later-attached storage base, minimizing the number of differently configured parts which must be inventoried by the manufacturer or retailer.

The only tool required to assemble a kit of the present invention is the ubiquitous screw driver. In fact, in one embodiment all screws are Allen screws and a small Allen wrench is included in the universal storage base set, so that the consumer would not need any tools on hand to assemble the storage base and turntable. By minimizing the number of parts and fasteners the consumer must grapple with, the assembly of the audiovisual component storage base with a television turntable is greatly simplified.

The present invention greatly simplifies providing an audiovisual component storage base and television turntable assembly kit while still providing a high degree of functionality of flexibility. One universal audiovisual storage base set adapts to any one of plurality of different sized television turntable sets, reducing the need to inventory a multiplicity of storage base kits. In addition, the present invention minimizes the number of tools, fasteners and components to fit an audiovisual storage stand to a television turntable. Finally, the present invention provides a television turntable and audiovisual component storage base which rotate together so both the audiovisual components and the television are positioned for optimal use by the consumer.

Although the present invention has been described with reference to preferred embodiments, workers skilled in the art will recognize that changes may be made in form and detail without departing from the spirit and scope of the invention.

What is claimed is:

1. An accessory kit usable with a separate television turntable kit for adding a shelf to the television turntable kit for holding an audiovisual component, the accessory kit consisting essentially of:

a base having a top surface and a bottom surface;

a plurality of support pillars, each pillar having a top surface and a bottom surface, the bottom surface of each of the support pillars being attachable to the top surface of the base, and the top surface of each of the support pillars being attachable to a bottom surface of a separately provided turntable platform, for adding the base as a shelf below and parallel to the turntable platform so that the turntable platform, the pillars, and the base define a space for receiving and supporting an audiovisual component on the base and beneath the turntable platform, wherein the turntable platform is part of a separately provided television turntable set, the television turntable set also including a rotating member which is attached to the bottom surface of the base;

a first plurality of fasteners for fastening the top surface of each of the pillars to the bottom surface of the turntable platform;

a second plurality of fasteners for fastening the bottom surface of each of the pillars to the top surface of the base; and a container for containing the base, the plurality of support pillars, and the first and second plurality of fasteners, so that the accessory kit is packaged for inventory and sale separately from the television turntable set, wherein the television turntable set is usable with or without the accessory kit, and the accessory kit is usable only with a television turntable set for adding a shelf to the television turntable set for holding an audiovisual component.

2. The kit of claim 1, wherein the distance between the top surface and bottom surface of each pillar is great enough to accommodate an audiovisual component.

3. The kit of claim 2, wherein the area of the top surface of the base between the plurality of pillars is large enough to accommodate an audiovisual component.

4. The kit of claim 3, wherein the area of the top surface of the base is approximately the same as the area of the top surface of the platform.

5. The kit of claim 3, wherein the area of the top surface of the base is less than the area of the top surface of the platform.

6. The kit of claim 3, wherein the base contains at least one hole for the attachment of the rotating member.

7. The kit of claim 6, wherein the base contains one hole, in the center of the bottom surface of the base, for the attachment of the rotating member.

8. The kit of claim 3, wherein the base contains a plurality of holes for the attachment of the pillars.

9. The kit of claim 8, wherein each of the plurality of pillars contains at least one hole for the attachment of the base.

10. The kit of claim 9, wherein each of the plurality of pillars contains two holes for the attachment of the base.

11. The kit of claim 9, wherein the holes in the pillars, disposed in the bottom surface of each of the plurality of pillars, align with the holes in the base, disposed in the top surface of the base.

12. The kit of claim 3, wherein the turntable platform contains a plurality of holes for the attachment of the pillars.

13. The kit of claim 12, wherein each of the plurality of pillars contains at least one hole for the attachment of a turntable platform.

14. The kit of claim 13, wherein each of the plurality of pillars contains two holes for the attachment of a turntable platform.

15. The kit of claim 13, wherein the holes in the pillars, disposed in the top surface of each of the plurality of pillars, align with the holes in the turntable platform, disposed in the bottom surface of the platform.

16. The kit of claim 1, in which the first plurality of fasteners are dowels.

17. The kit of claim 16, in which the first plurality of fasteners consists of four dowels.

18. The kit of claim 1, in which the second plurality of fasteners are screws.

19. The kit of claim 18, in which the second plurality of fasteners consists of four screws.

20. A method for modifying a television turntable to add an audiovisual component storage shelf, the method comprising:

obtaining a first package containing any one of a plurality of variously sized television turntable sets, the one of the plurality of television turntable sets comprising a rotating member and a turntable platform, the turntable platform having a top surface and a bottom surface;

obtaining a second package containing an accessory kit for modifying a turntable set to add a storage shelf, the kit being separately packaged from the turntable set for inventory and sale, the accessory kit being usable only with a television turntable set for adding a shelf to the television turntable set for holding an audiovisual component, the kit having:

a base having a top surface and a bottom surface;

a plurality of support pillars, each pillar having a top surface and a bottom surface, so that the bottom surface of each of the support pillars may be attached to the top surface of the base, and the top surface of each of the support pillars may be attached to the bottom surface of the turntable platform, for thereby adding the base as a shelf below and parallel to the turntable platform so that the turntable platform, the pillars, and the base define a space for receiving and supporting an audiovisual component; and a plurality of fasteners;

turning the turntable set upside down;

removing the rotating member from the platform;

attaching the bottom surface of each of the plurality of pillars to the top surface of the base;

attaching the top surface of each of the plurality of pillars to the bottom surface of the platform;

attaching the rotating member to the bottom surface of the base; and turning the modified turntable set with audiovisual component storage shelf rightside up.

21. The method of claim 20, wherein the rotating member is attached to the bottom surface of the base by a screw.

22. The method of claim 20, wherein the top surface of each of the plurality of pillars is attached to the bottom surface of the platform by a plurality of dowels.

23. The method of claim 20, wherein the bottom surface of each of the plurality of pillars is attached to the top surface of the base by a plurality of screws.

24. A system for producing a television turntable with an audiovisual component storage shelf, the system comprising:

a first package containing a television turntable kit, the television turntable kit comprising a rotating member and a turntable platform, the turntable platform having a top surface and a bottom surface; and a second package containing an audiovisual component storage shelf kit, the second package being packaged for inventory and sale separately from the first package, the audiovisual component storage shelf kit of the second package being usable only with a television turntable kit of the first package for adding a shelf to the television turntable kit for holding an audiovisual component, the audiovisual component storage shelf kit comprising:

a base having a top surface and a bottom surface;

a plurality of support pillars, each pillar having a top surface and a bottom surface, the bottom surface of each of the support pillars being attachable to the top surface of the base, and the top surface of each of the support pillars being attachable to the bottom surface of the turntable platform, for adding the base as a shelf below and parallel to the turntable platform so that the turntable platform, the pillars, and the base define a space for receiving and supporting an audiovisual component on the base and beneath the turntable platform;

a first plurality of fasteners for fastening the top surface of each of the pillars to the bottom surface of the turntable platform; and a second plurality of fasteners for fastening the bottom surface of each of the pillars to the top surface of the base.

25. The system of claim 24, wherein the distance between the top surface and bottom surface of each pillar is great enough to accommodate an audiovisual component.

26. The system of claim 25, wherein the area of the top surface of the base between the plurality of pillars is large enough to accommodate an audiovisual component.

27. The system of claim 26, wherein the base comprises a hole for the attachment of the rotating member.

28. The system of claim 25, wherein a hole disposed in the bottom surface of each of the plurality of pillars aligns with a hole disposed in the top surface of the base.

29. The system of claim 25, wherein a hole disposed in the top surface of each of the plurality of pillars aligns with a hole disposed in the bottom surface of the platform.

30. The system of claim 24, in which the first plurality of fasteners are dowels.

31. The system of claim 24, in which the second plurality of fasteners are screws.

32. A system for producing a television turntable with an audiovisual component storage shelf, the system comprising:

a first package containing a television turntable kit, the television turntable kit comprising a rotating member and a turntable platform, the turntable platform having a top surface and a bottom surface, wherein the television turntable kit is usable by itself to produce a television turntable; and a second package containing an audiovisual component storage shelf kit, the second package being packaged for inventory and sale separately from the first package, the audiovisual component storage shelf kit of the second package being usable only with a television turntable kit of the first package for adding a shelf to the television turntable kit for holding an audiovisual component, the audiovisual component storage shelf kit comprising:

a base having a top surface and a bottom surface;

a plurality of support pillars, each pillar having a top surface and a bottom surface, the bottom surface of each of the support pillars being attachable to the top surface of the base, and the top surface of each of the support pillars being attachable to the bottom surface of the turntable platform, for adding the base as a shelf below and parallel to the turntable platform so that the turntable platform, the pillars, and the base define a space for receiving and supporting an audiovisual component on the base and beneath the turntable platform;

a first plurality of fasteners for fastening the top surface of each of the pillars to the bottom surface of the turntable platform; and a second plurality of fasteners for fastening the bottom surface of each of the pillars to the top surface of the base.

* * * * *